US006615783B2

(12) United States Patent
Haas et al.

(10) Patent No.: US 6,615,783 B2
(45) Date of Patent: Sep. 9, 2003

(54) SWITCHABLE TAPPET FOR THE DIRECT TRANSMISSION OF A CAM LIFT TO A TAPPET PUSH ROD

(75) Inventors: Michael Haas, Weisendorf (DE); Henning Karbstein, Strullendorf (DE); Martin Rauch, Bamberg (DE); Dieter Schmidt, Nuremberg (DE)

(73) Assignee: Ina Schaeffler KG (DE)

( * ) Notice: Subject to any disclaimer, the term of this patent is extended or adjusted under 35 U.S.C. 154(b) by 0 days.

(21) Appl. No.: 10/093,018

(22) Filed: Mar. 7, 2002

(65) Prior Publication Data

US 2002/0124824 A1 Sep. 12, 2002

Related U.S. Application Data

(60) Provisional application No. 60/274,484, filed on Mar. 8, 2001.

(30) Foreign Application Priority Data

Mar. 9, 2001 (DE) ..... 101 11 512

(51) Int. Cl.[7] ..... F01L 1/14

(52) U.S. Cl. ..... 123/90.48; 123/90.55; 123/90.35

(58) Field of Search ..... 123/90.48, 90.16, 123/90.35, 90.49, 90.52, 90.55–90.57

(56) References Cited

U.S. PATENT DOCUMENTS

| | | | | |
|---|---|---|---|---|
| 6,196,175 | B1 | 3/2001 | Church | |
| 6,497,207 | B2 * | 12/2002 | Spath et al. | 123/90.16 |
| 6,513,470 | B1 * | 2/2003 | Hendriksma et al. | 123/90.16 |

FOREIGN PATENT DOCUMENTS

| | | |
|---|---|---|
| DE | 4238325 | 5/1994 |
| DE | 4323555 | 1/1995 |
| DE | 19914046 | 9/2000 |

* cited by examiner

*Primary Examiner*—Thomas Denion
*Assistant Examiner*—Kyle Riddle
(74) *Attorney, Agent, or Firm*—Muserlian, Lucas and Mercanti

(57) ABSTRACT

The invention proposes a switchable tappet (1) for the direct transmission of a cam lift to a tappet push rod. A coiled compression spring (15), used as a lost motion spring, for loading the inner element (4) is shifted axially out of a housing (2). For this purpose, the inner element (4) comprises an extension **(15*a*) that projects out of the housing (2) and is surrounded by the coiled compression spring (15). This measure contributes to minimizing the total mass of the switchable tappet (1) because the overall length of the housing (2)** is shortened.

10 Claims, 1 Drawing Sheet

16,17
20
13a
5
15
15a
12
13
1

15
16,18
11
15a
19,21
12
1
10

1
16,18
15
15a
13a
19,22
4
5
3
9

20
2
1
7
16,17
15
15a
14
6
8

SWITCHABLE TAPPET FOR THE DIRECT TRANSMISSION OF A CAM LIFT TO A TAPPET PUSH ROD

This application claims the benefit of provisional application Ser. No. 60/274,484 filed Mar. 8, 2001.

DESCRIPTION

1. Field of the invention

The invention concerns a switchable tappet for a direct transmission of a cam lift to a tappet push rod in a valve train of an internal combustion engine, said tappet comprising a housing in whose axially extending cavity a longitudinally displaceable inner element is arranged that can be connected to the housing, in a relative position to the housing, by a coupling means, said housing comprising on an end facing away from the cavity, a contact surface for a cam, and the inner element comprising on a side of the cavity, a support for the tappet push rod, which inner element extends beyond the cavity by an extension and is biased away from the housing by at least one coiled compression spring.

2. Background of the invention

A tappet of the pre-cited type is disclosed in FIG. 2 of DE 198 44 202 which is considered to be generic art. It can be seen that a compression spring assembly extends within the housing. The compression spring assembly is supported at one end on the bottom of the housing and acts at the other end on an undersurface of the inner element. Due to the arrangement of the compression spring assembly within the housing, this latter has an unnecessary overall length. This is made up at least of the required compression path length plus the block dimension of the compression spring assembly. Due to the relatively large overall length of the housing that is made out of a relatively thick-walled tubular section, the total mass of the switchable tappet is unnecessarily increased.

OBJECTS OF THE INVENTION

It is an object of the invention to provide a switchable tappet of the pre-cited type whose total mass is decreased by simple measures.

This and other objects and advantages of the invention will become obvious from the following detailed description.

SUMMARY OF THE INVENTION

The invention achieves the above objects by the fact that the coiled compressions spring is arranged at least substantially around the extension of the inner element and acts at one end on a support of the inner element facing away from the reception and at another end against an edge of the reception or on a section of the reception near the edge. Due to this "outwards" shifting of the coiled compression spring, a housing can be realized that is markedly shorter than present housings. Thus, the total mass of the switchable tappet is reduced by very simple measures because all that is required within the housing now is a displacement path length for the inner element.

In a particularly advantageous embodiment of the invention, the housing has no bottom for supporting one end of the coiled compression spring in its interior, so that the housing has a completely open, tube-like configuration. This is a further step towards realizing a light-weight construction.

A particularly low-friction cam contact is obtained by making the cam-contacting surface on the housing, for example, as a roller mounted on a rolling bearing. However, a sliding contact may also be used for this purpose.

For further minimizing the overall height of the housing, and thus also the total mass, it is proposed to provide a depression of cylindrical shape (as viewed in roller direction) on the end of the inner element facing the roller. This enables the inner element in its switched-off state to "plunge" partly over the roller.

A simple possibility for supporting the coiled compression spring that is shifted outwards is to support it on an edge of the housing or on a section of the housing near the edge. Alternatively, the reception of the housing may be given a radially stepped configuration starting from its edge so that the coiled compression spring is then supported on an annular shoulder thus formed.

A mounting of the coiled compression spring on the side of the inner element can be effected optionally through a separate stop member such as a ring, or through an annular collar formed integrally on the inner element. These measures can be implemented in a very simple and economic manner.

In a further embodiment of the invention, the extension of the inner element which is surrounded by the coiled compression spring is made as a separate and thin-walled component such as a sheet metal part. This may be clipped or snapped or fixed in another similar manner on the outer or the inner peripheral surface of the inner element. It goes without saying that in this context, a person skilled in the art would also consider other simple connecting methods like positive engagement, force-locking or fusion of materials or combinations of these.

According to another feature of the invention, the extension of the inner element is slightly funnel-shaped so as to form a lead-in aid for the tappet push rod.

Advantageously, the tappet comprises a hydraulic clearance compensation element of a type, known per se. In this way, expensive mechanical clearance adjusting measures can be dispensed with. The clearance compensation element forms a part of the inner element.

In those cases of use in which the tappet push rod has a relatively large inclination relative to the switchable tappet, a very "high-level" support must be created for the tappet push rod on the inner element. Therefore, according to a further feature of the invention, a pressure piston of the clearance compensation element on which one end of the tappet push rod is supported extends axially relatively far out of the housing so as to protrude distinctly into the extension of the inner element. It is also conceivable to advantageously configure the pressure piston so that it encloses a relatively large reservoir for hydraulic medium. This can be of advantage for a cold start of the internal combustion engine because an adequate amount of hydraulic medium is then immediately available for clearance compensation.

BRIEF DESCRIPTION OF THE DRAWINGS

The invention will now be described with reference to the attached drawings in which.

DETAILED DESCRIPTION OF THE DRAWINGS

Figures 1, 2, 3, 4:
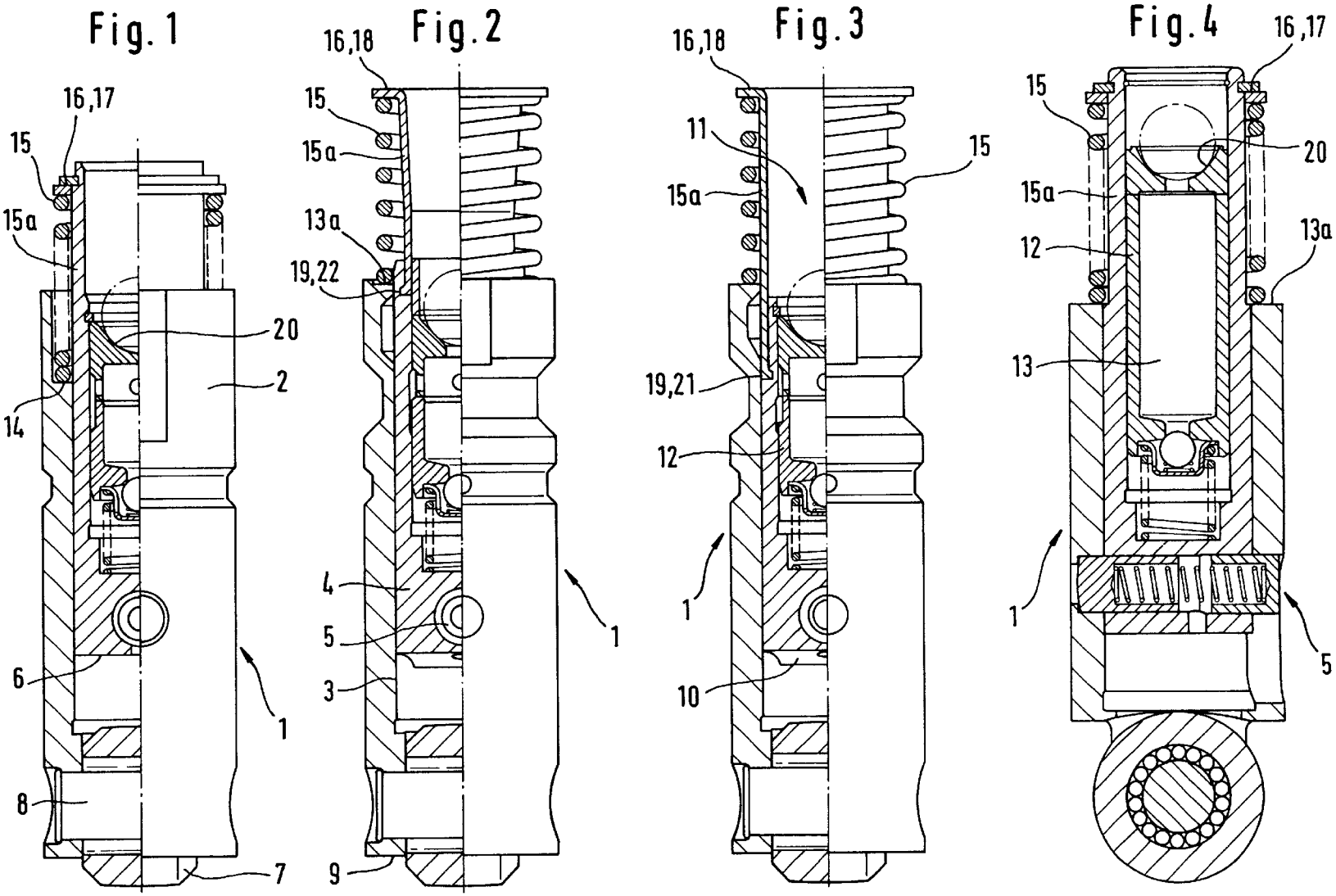
FIG. 1 is a longitudinal section through a switchable tappet having an inner element with an integrally formed extension extending at a right angle to the coupling means.
FIG. 2 is a view similar to that of FIG. 1, but with a separate extension.
FIG. 3 shows a tappet similar to that of FIG. 2, but with an alternative manner of fixing the extension.
FIG. 4 shows a tappet similar to the above tappets wherein the coupling means is shown in section and the pressure piston is axially lengthened.

The figures disclose a switchable tappet 1. This serves for the direct transmission of a cam lift to a tappet push rod. The tappet 1 has a thin-walled housing 2 that in the present case has an open tube-like configuration. An inner element 4 is received for axial displacement in a cavity 3 of the housing 2. In one stroke position, the inner element 4 can be connected to the housing 2 by a coupling means 5, not further specified (see also FIG. 4). This coupling means 5 is situated in the region of one end 6 of the inner element 4, which end 6 faces a contact surface 7 for a cam, not shown. The contact surface 7 is configured in the present case as a roller mounted through a rolling bearing on a pin 8 that, in its turn, is mounted on one end 9 of the housing 2. As best seen in FIGS. 2 and 3, the end 6 can comprise a cylindrical depression 10 that extends in a direction of an extent of the contact surface 7 that is configured as a roller. In an uncoupled state of the inner element 4 and the housing 2, the inner element 4 can, so to speak, plunges with its depression 10 partly over the contact surface 7. This measure, together with other measures described below, has an advantageous effect on the total height and, thus, on the total weight of the switchable tappet 1.

The inner element 4 further comprises a hydraulic clearance compensation element 11 having a pressure piston 12 that encloses a reservoir 13 for hydraulic medium.

A region of the housing 2 opposite from the end 9 comprises an edge 13*a* which as disclosed in FIG. 1, can also have a stepped configuration and, in the present case, possesses an annular shoulder 14. A coiled compression spring 15 is supported on this shoulder 14 (FIG. 1) or directly on the edge 13*a* (FIGS. 2 to 4). The coiled compression spring 15 encloses an extension 15*a* which lengthens the inner element 4 beyond the edge 13*a* of the housing 2. At another end, the coiled compression spring 15 is mounted on a support 16 that is made as a separate stop member 17 (see FIGS. 1, 4) or is configured as an annular collar 18 (see FIGS. 2, 3) formed integrally on the extension 15*a* which may have a slightly conical shape (FIG. 2). Through the external arrangement of the coiled compression spring 15 herein disclosed, in contrast to the prior art, the overall length of the housing 2 can be clearly minimized. This reduces the mass of the relatively thick-walled housing 2 and, thus, of he switchable tappet 1. Furthermore, it is possible to use only one coiled compression spring 15 while in the prior art, due to the limited space available, a compression spring assembly is required.

FIGS. 2 and 3 disclose that the extension 15*a* can also be made as a separate component. It is conceivable, for example, to make this out of sheet metal which, again, has a positive effect on the total mass of the tappet 1. FIG. 2 shows that the extension 15*a* can be connected to the inner element 4, for example, by a clip connection 19 on the inside. Alternatively, as shown in FIG. 3, the clip connection 19 may also be situated on the outside.

As can be seen in FIG. 2, the separate extension 15*a* with its inner clip connection 19 is slightly funnel-shaped. In this way, a lead-in aid for the tappet push rod is created by simple measures.

A person skilled in the art will discern in FIG. 4, a switchable tappet 1 in which the pressure piston 12 of the clearance compensation element 11 is extended distinctly beyond the edge 13*a* of the housing 2. As mentioned, the extension 15*a* is integral to the inner element 4. This measure is of particular advantage when the tappet push rod has a relatively large inclination relative to the tappet 1 which makes a high-level support 20 for the tappet push rod desirable.

What is claimed is:

1. A switchable tappet for a direct transmission of a cam lift to a tappet push rod in a valve train of an internal combustion engine, said tappet comprising a housing in whose axially extending cavity a longitudinally displaceable inner element is arranged that an be connected to the housing, in a relative position to the housing, by a coupling means, said housing comprising on an end facing away from the cavity, a contact surface for a cam, and the inner element comprising on a side of the cavity, a support for the tappet push rod, which inner element extends beyond the cavity by an extension and is biased way from the housing by at least one coiled compression spring, the coiled compression springs arranged at least substantially around the extension of the inner element and acts at one end on a support of the inner element facing away from the cavity and at another end against a section of the cavity near the edge the extension of the inner element is made as a separate component out of thin-walled light-weight material and is connected to one of an outer peripheral surface and an inner peripheral surface on the outside of the inner element by a clip or snap connection and starting from the edge, the cavity of the housing comprises a radially inwards stepped configuration so that the section near the edge is an annular shoulder situated within the cavity.

2. A tappet of claim 1, wherein the housing is thin-walled and has a continuously open, tube-like geometry.

3. A tappet of claim 1, wherein the contact surface for the cam is made as a rotatable roller that is mounted on the housing on a pin.

4. A tappet of claim 3, wherein an end of the inner element facing the contact surface comprises a cylindrical depression extending in a direction of the contact surface.

5. A tappet of claim 1, wherein the light-weight material is sheet metal.

6. A tappet of claim 1, wherein the support for one end of the coiled compression spring on the inner element is made as an annular collar formed integrally on the extension.

7. A tappet of claim 1, wherein the support for one end of the coiled compression spring on the inner element is made as a separate stop member.

8. A tappet of claim 7, wherein the separate member is a locking ring.

9. A tappet of claim 1, wherein a hydraulic clearance compensation element is installed in the inner element.

10. A tappet of claim 1 wherein the extension of the inner element has a slightly conical shape.

* * * * *